US011612471B2

(12) United States Patent
Li et al.

(10) Patent No.: US 11,612,471 B2
(45) Date of Patent: Mar. 28, 2023

(54) WING PROTECTOR FOR WINGED CAPSULE AND METHOD OF USING SAME

(71) Applicants: Elanco Tiergesundheit AG, Basel (CH); ELANCO US INC., Greenfield, IN (US)

(72) Inventors: Jianbin Li, Greenfield, IN (US); Benjamin Jeffrey Cooper, Greenfield, IN (US)

(73) Assignee: ELANCO US INC., Greenfield, IN (US)

( * ) Notice: Subject to any disclaimer, the term of this patent is extended or adjusted under 35 U.S.C. 154(b) by 0 days.

(21) Appl. No.: 17/634,898

(22) PCT Filed: Aug. 14, 2020

(86) PCT No.: PCT/US2020/046394
§ 371 (c)(1),
(2) Date: Feb. 11, 2022

(87) PCT Pub. No.: WO2021/030696
PCT Pub. Date: Feb. 18, 2021

(65) Prior Publication Data

US 2022/0265412 A1 Aug. 25, 2022

Related U.S. Application Data

(60) Provisional application No. 62/886,594, filed on Aug. 14, 2019.

(51) Int. Cl.
*A61D 7/00* (2006.01)

(52) U.S. Cl.
CPC ..... *A61D 7/00* (2013.01)

(58) Field of Classification Search
CPC ..... A61D 7/00
See application file for complete search history.

(56) References Cited

U.S. PATENT DOCUMENTS 3,548,785 A * 12/1970 Cooper ..... A23K 40/35 119/174
4,251,506 A * 2/1981 Laby ..... A61K 9/0068 424/484
4,416,659 A * 11/1983 Simpson ..... A61D 7/00 604/48
4,623,345 A * 11/1986 Laby ..... A61D 7/00 604/93.01

(Continued)

FOREIGN PATENT DOCUMENTS

EP 0174865 A2 3/1986
WO WO-03024355 A1 * 3/2003 ..... A61D 7/00

OTHER PUBLICATIONS

International Search Report and Written Opinion issued in PCT/US2020/046394, dated Aug. 12, 2020.

*Primary Examiner* — Laura A Bouchelle
*Assistant Examiner* — John A Doubrava
(74) *Attorney, Agent, or Firm* — Barnes & Thornburg LLP

(57) ABSTRACT

An arrangement for delivery of a substance to an animal and a method of protection of a winged capsule. The arrangement may include a winged capsule including a capsule and wings, the capsule being adapted to deliver the substance to the animal, and the wings affixed to the capsule and operable to fold for insertion into the animal and to expand after insertion. The arrangement may include a wing protector including a slot sized and configured to receive at least a portion of each of the wings and removably attach the winged capsule to the wing protector. The method may include removably attaching the winged capsule to the wing protector to form a protected winged capsule; inserting a plurality of the protected winged capsule into a bag; removing one of the protected winged capsule from the bag; and removing the wing protector from the protected winged capsule.

20 Claims, 8 Drawing Sheets

(56) References Cited

U.S. PATENT DOCUMENTS

| | | | | | |
|---|---|---|---|---|---|
| 4,671,789 | A * | 6/1987 | Laby | A61D 7/00 | 604/93.01 |
| 4,687,480 | A * | 8/1987 | Laby | A61M 31/002 | 604/105 |
| 4,883,484 | A * | 11/1989 | Shepherd | A61K 9/0068 | 424/438 |
| 5,122,128 | A * | 6/1992 | Cardinal | A61K 9/0068 | 604/890.1 |
| 5,277,912 | A * | 1/1994 | Lowe | A61K 9/0068 | 604/890.1 |
| 5,697,384 | A * | 12/1997 | Miyawaki | A01K 11/007 | 128/903 |
| 6,444,224 | B1 * | 9/2002 | Rathbone | A61D 7/00 | 424/430 |
| 8,734,430 | B2 * | 5/2014 | Holmes | A61K 9/0068 | 424/422 |
| D898,907 | S * | 10/2020 | Gill | D24/127 | |
| D909,604 | S * | 2/2021 | Gill | D24/231 | |
| 2002/0045883 | A1 * | 4/2002 | Jellie | A61M 37/0069 | 604/514 |
| 2012/0123394 | A1 * | 5/2012 | Holmes | A61K 9/0068 | 604/891.1 |
| 2014/0200553 | A1 * | 7/2014 | Johnson | A61M 5/1452 | 604/286 |
| 2014/0350529 | A1 * | 11/2014 | Holmes | A61D 7/00 | 604/891.1 |
| 2016/0030084 | A1 * | 2/2016 | Johnson | A61D 7/00 | 600/35 |
| 2018/0200036 | A1 * | 7/2018 | Rathbone | A61K 9/0036 | |
| 2021/0000580 | A1 * | 1/2021 | Gill | B29C 66/71 | |

* cited by examiner

WING PROTECTOR FOR WINGED CAPSULE AND METHOD OF USING SAME

CROSS-REFERENCE TO RELATED APPLICATIONS

This International Application claims the benefit of, and priority from, U.S. Patent Application No. 62/886,594, filed Aug. 14, 2019, which is incorporated herein by reference in its entirety.

FIELD OF THE DISCLOSURE

The disclosure relates generally to a device configured to protect a winged capsule from damage.

BACKGROUND OF THE DISCLOSURE

Kexxtone is a controlled release formulation of monensin (as monensin sodium) contained in a plastic capsule equipped with retaining wings. Slowly releasing monensin from an opening at the distal end of the capsule, the capsule will remain effective for an average of 95 days after administration in lactating dairy cattle. To administer monensin, the wings of the winged capsule are folded down along the body of the capsule and then placed in an administration tool. The administration tool containing the winged (folded) capsule is introduced into the animal's mouth; then the administration tool is triggered by pressing a plunger to expel the winged capsule into the pharynx of the animal; at which time the wings; which are flexible and resilient, expand and contact the pharynx to keep the winged capsule in place and prevent regurgitation of the winged capsule by the animal.

The wings are flexible and resilient to enable insertion and self-expansion, and to maintain the capsule in position while also preventing tissue damage. The capsule has a rounded top; or dome, and the wings are attached to the center of the dome. The rounded shape of the dome along a plane traversing the wings, or folding plane, facilitates folding of the wings, therefore the attachment surface, or joint, is minimized to maximize flexing of the wings while maintaining a small profile suitable for insertion into the pharynx. The joint may comprise a small amount of material forming a neck between the wings and the surface of the dome.

After manufacture, multiple winged capsules are placed inside packaging, typically a bag. Placing of winged capsules in a bag is illustrated in FIG. 13. It has been found that in the process of packaging the winged capsule and transporting the bags; wings might bend near the joint (where the wings are substantially rigid) past the point of material yield, at which point they no longer recover their functional shape. Wings bent past the point of material yield are shown in FIGS. 14 and 15. The bent wings might also break and separate from the bolus. The damaged devices must be discarded taking care that they are properly disposed in light of their content. An economical solution is needed to prevent damage to the winged capsules to reduce waste and disposal costs.

SUMMARY OF THE DISCLOSURE

An arrangement of a winged capsule and a wing protector, a method of protection of the winged capsule, and a wing protector are provided herein. The wing protector is suitable to prevent damage to the winged capsule.

In a first aspect, the disclosure provides an arrangement for delivery of a substance to an animal. In a first embodiment of the first aspect, the arrangement comprises a winged capsule including a capsule and wings, the capsule being adapted to deliver the substance to the animal, and the wings affixed to the capsule and operable to fold for insertion into the animal and to expand after insertion; and a wing protector including a slot sized and configured to receive at least a portion of each of the wings and removably attach the winged capsule to the wing protector.

In variations of the first embodiment, the wing protector may comprise a top wall; a lateral wall extending from the top wall, and a wing retainer extending from the lateral wall to form; together with the top wall, the slot.

The wing retainer may be sized and shaped to form a wing well.

The wing protector may comprise an opposite lateral wall opposite to the lateral wall and extending from the top wall; and an opposite wing retainer extending from the opposite lateral wall to form an opposite slot, the slot and the opposite slot forming a channel.

The slot and the opposite slot may be parallel to each other along a longitudinal axis of the wing protector.

The wing protector may include a dome cage in the lateral wall and the wing retainer, the dome cage having a length along a longitudinal direction greater than a diameter of the neck.

The wing protector may be made from a flexible material that is sufficiently flexible along a transverse direction to enable flexure of the top wall to expand a gap between the wing retainer and the opposite wing retainer until the gap is greater than a width of the wings, thereby enabling insertion of the wings through the expanded gap into the channel.

In another variation of the first embodiment, the wing retainer is coextensive with the top wall.

In a further variation of the first embodiment, the wing retainer further includes a dome cage formed by a cutout in the wing retainer.

In a second embodiment of the first aspect, the arrangement comprises a winged capsule including a capsule and wings, the capsule being adapted to deliver the substance to the animal, and the wings affixed to the capsule and operable to fold for insertion into the animal and to expand after insertion; and a wing protector including a slot sized and configured to receive at least a portion of each of the wings and removably attach the winged capsule to the wing protector, wherein the wing protector further includes a bottom wall extending from the lateral wall opposite the top wall to form the slot therebetween.

In a second aspect, a method of protection of a winged capsule is provided. In a first embodiment of the second aspect, the method comprises providing an arrangement comprising: a winged capsule including a capsule and wings, the wings connected to the capsule and adapted to fold for insertion into an animal and to expand after insertion, and a wing protector including a slot sized and configured to receive at least a portion of each of the wings and removably attach the winged capsule to the wing protector. The method further comprises removably attaching the winged capsule to the wing protector to form a protected winged capsule; inserting a plurality of the protected winged capsule into a bag; removing one of the protected winged capsule from the bag; and removing the wing protector from the protected winged capsule.

In a third aspect, a wing protector to protect a winged capsule including a capsule and foldable wings affixed to the capsule is provided. In some embodiments, the wing protector comprises: a top wall; a lateral wall extending from the top wall; and a slot sized and shaped to receive at least a portion of each of the wings and removably attach the winged capsule to the wing protector, the slot formed in part by the top wall and the lateral wall.

DESCRIPTION OF THE DRAWINGS

The following detailed description of various embodiments will be better understood when read in conjunction with the appended drawings. It should be understood, however, that the invention is not limited to the precise arrangements and instrumentalities of the embodiments shown in the drawings.

Figure 1:
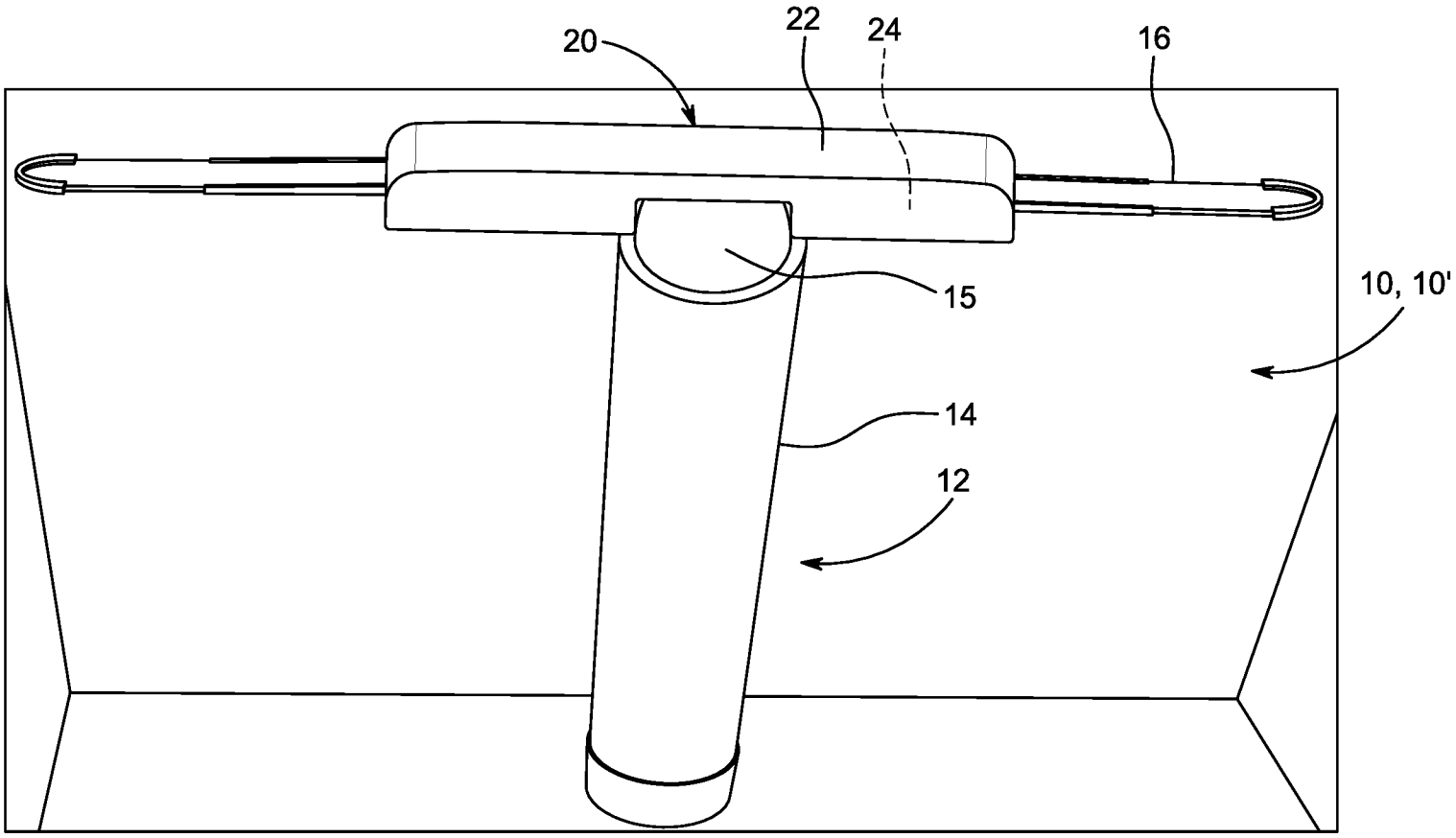
FIG. 1 is a perspective view of an embodiment of an arrangement, in an assembled state, comprising a winged capsule and a wing protector.

In the drawings, corresponding reference characters indicate corresponding parts, functions, and features throughout the several views. Although the drawings represent embodiments of various features and components according to the present invention, the drawings are not necessarily to scale and certain features may be exaggerated in order to better illustrate and explain the present invention. However, the invention is not limited to the precise arrangements and instrumentalities of the embodiments shown in the drawings.

DETAILED DESCRIPTION OF DISCLOSED EMBODIMENTS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention as set forth in the claims.

Figure 2:
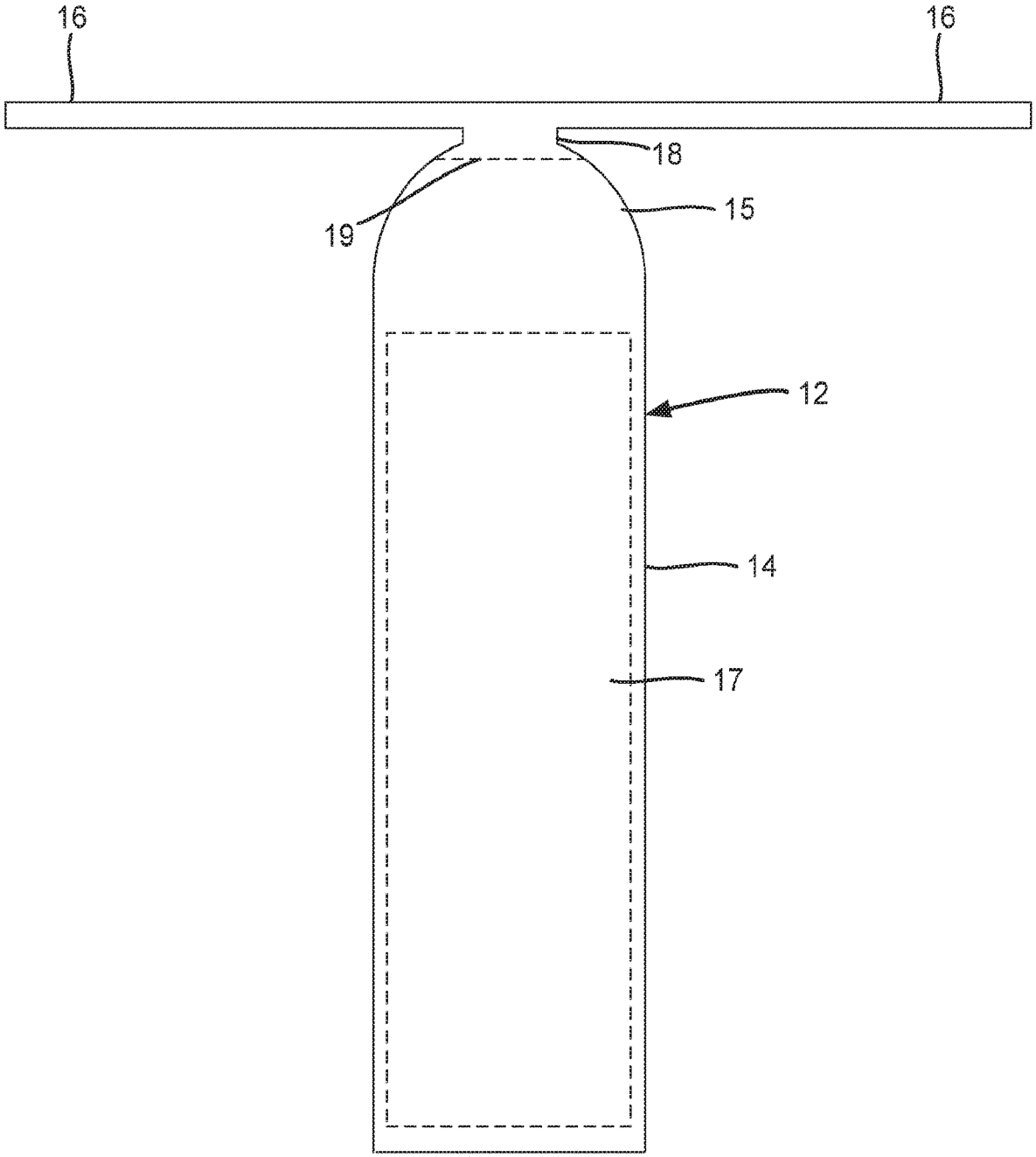
PRIOR ART Figure 2
FIG. 2 is a side view of an embodiment of a winged capsule.
Figure 3:
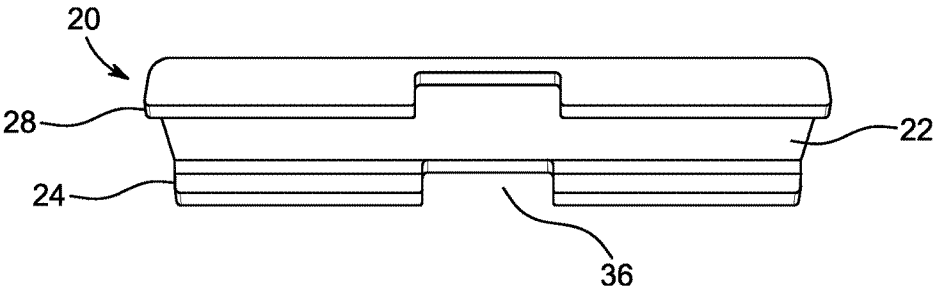
FIGS. 3-6 are perspective, transverse side, longitudinal side, and longitudinal side cross-section views of an embodiment of a wing protector.
Figure 5:
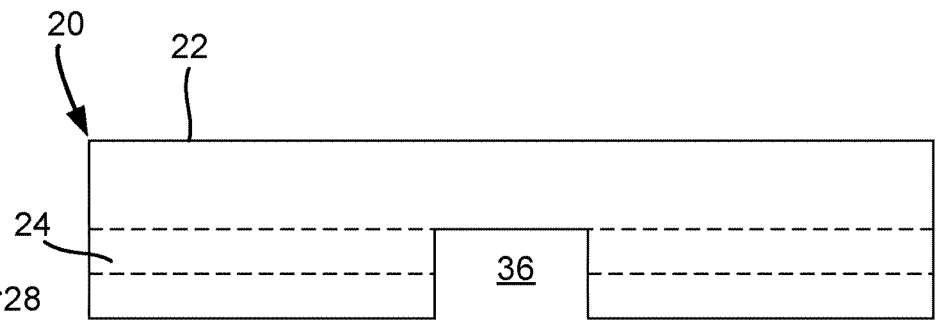
Figure 6:
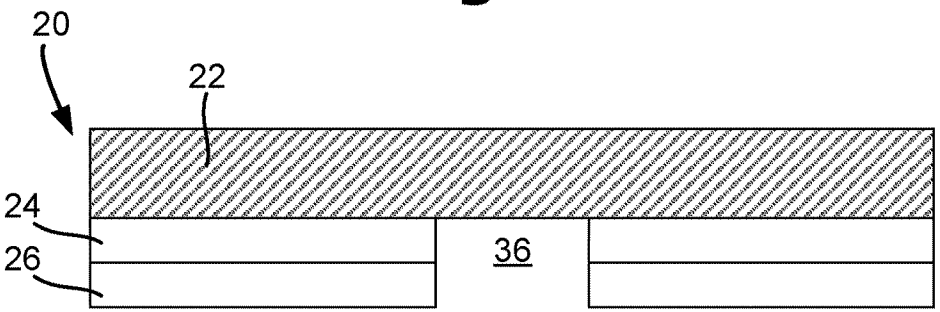

FIG. 1 is a perspective view of an embodiment of an arrangement (or protected winged capsule) 10, in an assembled state, comprising a winged capsule 12 and a wing protector 20. FIG. 2 is a side view of an embodiment of the winged capsule shown in FIG. 1. Winged capsule 12 includes a capsule 14 having a dome 15 and including, wings 16, a substance 17 in capsule 14, and a joint 18, optionally a neck, connecting wings 16 with capsule 14. A stabilization surface 19 (described below) is indicated by a dashed line on dome 15. It should be understood that stabilization surface 19 (illustrated by a line but encompassing the surface(s) of the wing protector that contacts the capsule, as discussed below (which area encompasses line 19) does not form part of the prior art and is illustrated merely to exemplify use of the novel and non-obvious wing protector describe herein. The substance may comprise monensin or other medicaments, vitamins, and any other substance suitable for delivery over extended periods of time.

FIGS. 3-6 are perspective, transverse side, longitudinal side, and longitudinal side cross-section views of an embodiment of wing protector 20. Wing protector 20 includes a top wall 22, a lateral wall 24 extending therefrom toward capsule 14 (downward in FIG. 1), a wing retainer 26 extending inward from lateral wall 24, an opposite lateral wall 28 extending from top wall 22 toward capsule 14 (downward), and an opposite wing retainer 30 extending inward from lateral wall 28. A gap 34 is defined as the smallest distance between wing retainer 26 and opposite wing retainer 30. Top wall 22, lateral wall 24, and wing retainer 26 form a slot 27. Top wall 22, opposite lateral wall 28, and opposite wing retainer 30 form a slot 31. Slots 27 and 31 (best seen in FIG. 4) define a channel 32 between them. Slots 27 and 31, and channel 32, are sized and configured to receive a portion of wings 16.

Optionally, a transverse slot made across wing retainer 26, opposite wing retainer 30, lateral wall 24, and opposite lateral wall 28, forms a dome cage 36. In one variation, longitudinal ribs are added on the top surface of the top wall to add longitudinal stiffening to the wing protector. The longitudinal ribs may extend from end to end or only extend partly from the center of wing protector 20 to an intermediate point along each wing, past the yield areas (described below). Addition of longitudinal ribs may enable reductions in the thickness of the top wall while adding longitudinal stiffness and reducing transverse stiffness.

In various embodiments described herein above and below, dome cage 36 is omitted. In one variation, longitudinal ribs are added on the top surface of the top wall.

In further various embodiments described herein above and below, dome cage 36 is provided, but the lateral walls are only partly cut, so that a portion of each lateral wall (connecting the top wall) remains, which stiffens the top wall while still permitting mounting on the wings without interference with the capsule. In one variation, longitudinal ribs are added on the top surface of the top wall.

Figure 4:
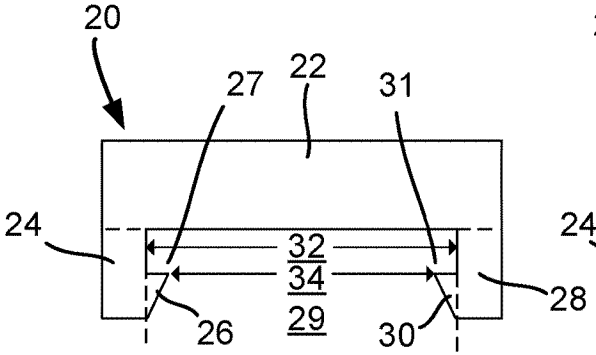
Figure 4A:
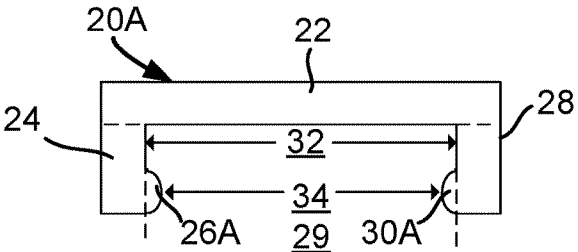
FIG. 4A is a transverse side view of another embodiment of a wing protector.

Wing retainers described herein may have any combination of shape and material sufficient to enable mounting of the wing protector on the wings, retaining of the wing protector, and removing of the wing protector. The material of the wing protector may comprise polymers. Example polymers include polypropylene and nylon. Stiffeners may be added to form a composition of stiffeners and polymers. Example stiffeners include glass bead and fibers. Example fibers include glass and carbon fibers. In the present embodiment, wing retainers 26 and 30 are depicted as barbs increasing in thickness as they extend inwardly (toward channel 32), The combination of the material flexibility and barb shape enables wing protector 20 to flex slightly to receive the wings and also permits removal of the wings. The thickness of the barb can be increased, thereby reducing gap 34, to increase the force required for mounting or removal. The thickness of top wall 22 can also be increased or reduced to affect flexure of wing protector 20, FIG. 4A illustrates a variation of the present embodiment, wing protector 20A, in which wing retainers 26A and 30A are shaped as arcuate protrusions protruding from walls 24, 28. The arcuate protrusions and the barbs provide a gap larger than the width of the wings at the most distal (relative to the top wall) edge of the wing retainer and a gap smaller than the width of the wings along their height, which may be referred to, collectively, as a "wing well" 29, Wing well 29 facilitates initiation of mounting and guides the wing into slot 32 as force is applied to overcome the resistance to insertion provided by the wing retainers. Thus, a wing protector may comprise a wing well of various shapes. The wing well may extend along the length of the wing protector or along portions thereof.

After assembly, if a force is applied to one (first) wing, the combination of the opposite (second) wing and the wing protector will provide an opposing force to protect the first wing. In some variations, the corners of wing retainer 26 and opposite wing retainer 30 (on each side of the transverse slot) provide four contact points for stabilization surface 19 of dome 15. The four contact points reduce the risk of damage by providing lateral support from dome 15 and, also relying on each wing and respective portion of wing protector 20 supporting the opposite wing, to keep wings 16 and capsule 14 aligned, preventing or limiting twisting of joint 18 or bending of one or both of wings 16 near where the wings contact the joint.

In one variation of the present embodiment, wing protectors 20, 20A (and wing protector 38, described below) comprises a single-piece of polymer material.

In some embodiments, wing protector 20 is removably attached to wings 16 by mounting wing protector 20 onto the wings from the top, allowing the wing retainers to slide past the edges of the wings. Wing protector 20 may flex slightly while being pressed onto the wings and may then regain its unflexed shape to remain mounted onto the wings. Before use, wing protector 20 is pulled in the reverse direction.

Figure 7:
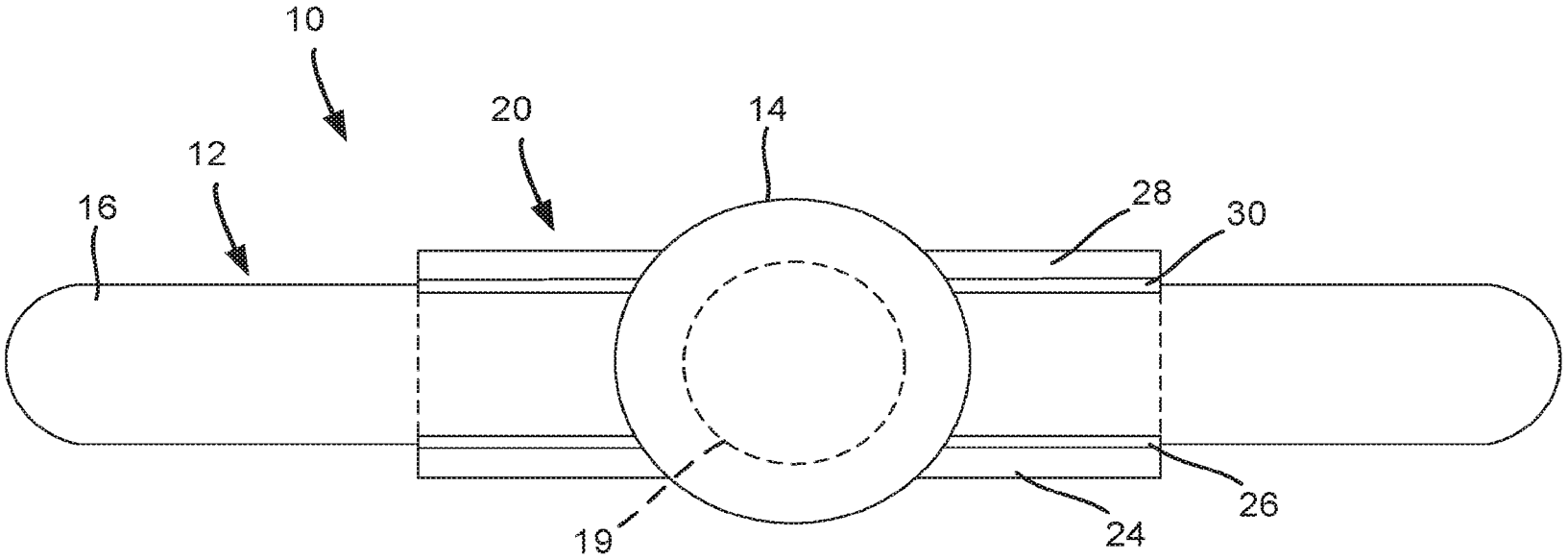
FIG. 7 is a bottom view of the arrangement of FIG. 1 showing a wing protector mounted on a winged capsule.

FIG. 7 is a bottom view of the arrangement of FIG. 1 showing a protected winged capsule 10 assembled as described above, by mounting wing protector 20 onto winged capsule 12 from the top (from the wing side of winged capsule 12).

Figure 8:
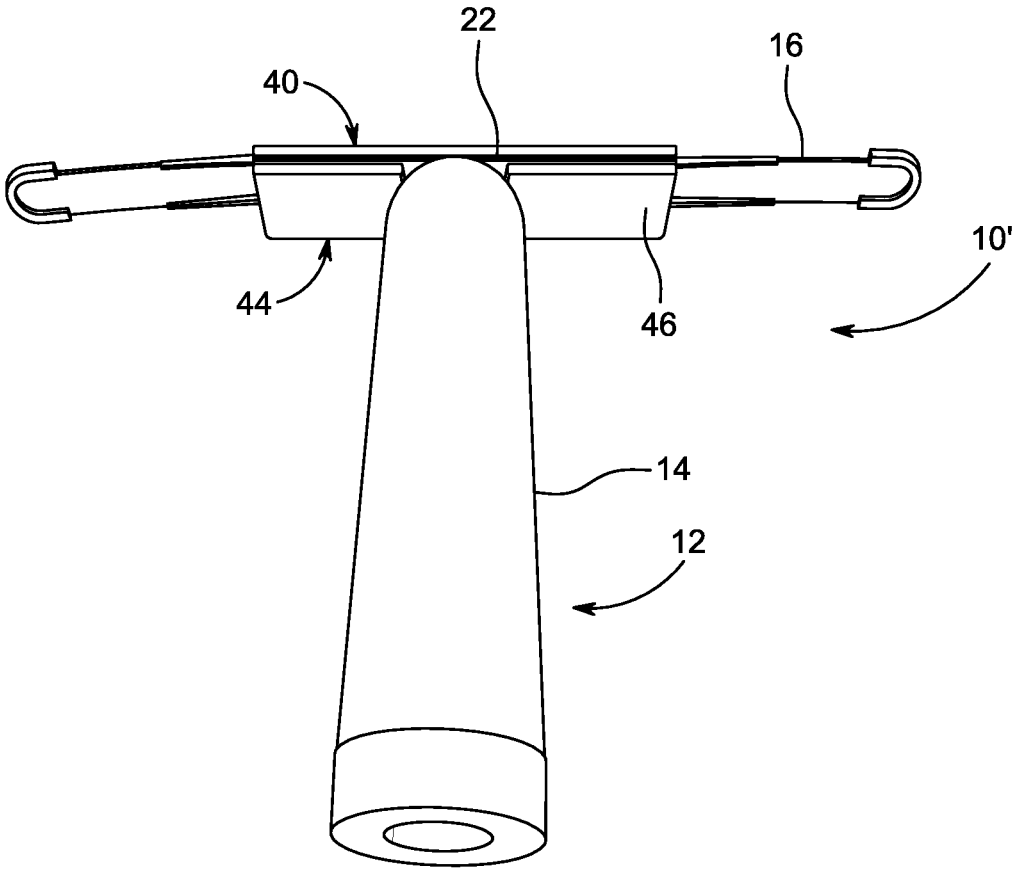
FIG. 8 is a perspective view of another embodiment of an arrangement, in an assembled state, comprising a winged capsule and a wing protector.
Figure 9:
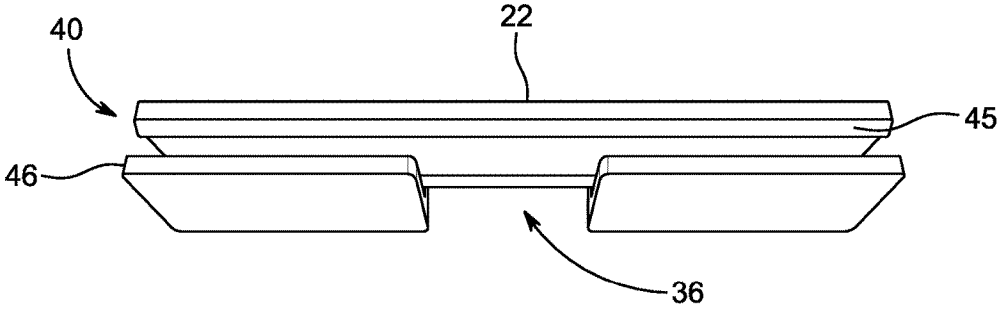
FIGS. 9-12 are perspective, transverse side, longitudinal side, and longitudinal side cross-section views of another embodiment of a wing protector.
Figure 11:
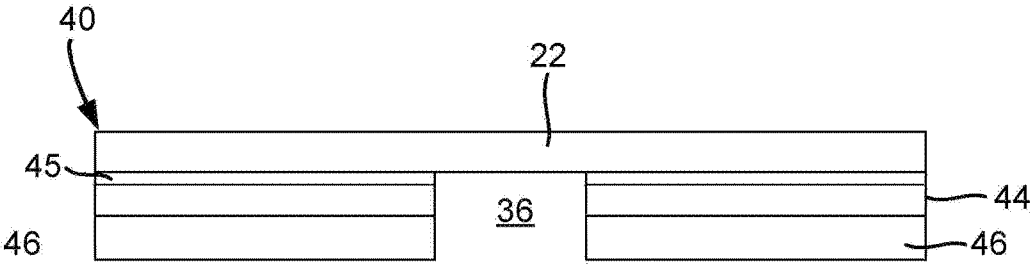
Figure 10:
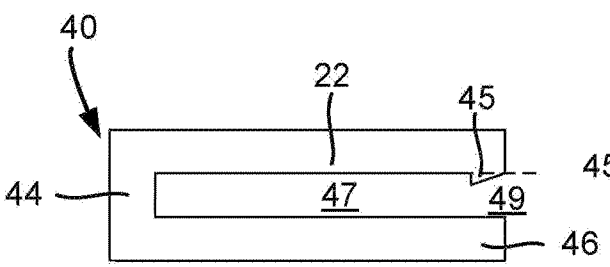
Figure 12:
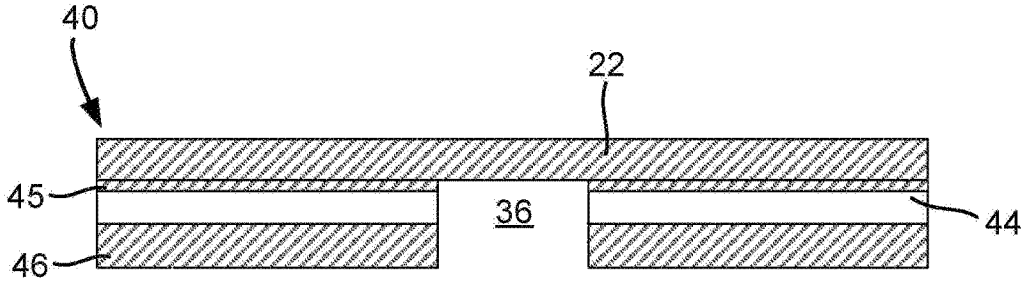

FIG. 8 is a perspective view of another embodiment of an arrangement, denoted by numeral 10', in an assembled state, of a protected winged capsule comprising winged capsule 12 and a wing protector 40. Wing protector 40 differs from wing protector 20 in that it only has a lateral wall on one side of top wall 22. FIGS. 9-12 are perspective, transverse side, longitudinal side, and longitudinal side cross-section views of wing protector 40. Wing protector 40 includes top wall 22, a lateral wall 44 extending therefrom toward capsule 14 (downward), and a bottom wall 46 extending inward from lateral wall 44. Top wall 22, lateral wall 44, and bottom wall 46 form a slot 47 sized and configured to receive a portion of wings 16. Dome cage 36 facilitates removable attachment of winged capsule 12 by insertion, in the transverse direction, of wings 16 into slot 47 with dome 15 aligned with dome cage 36. A wing retainer 45 is shown. The wing retainer may comprise any shape sufficient to facilitate entry of the wings and removal thereof, as described above with reference to FIGS. 4 and 4A. Wing retainer 45 cooperates with bottom wall 46 to form a wing well 49. In a variation of the present embodiment, an opposite wing retainer 45 is added to the bottom wall.

The wing retainers described herein do not need to be of matching lengths, One wing retainer may have one length and the opposite wing retainer may have a different lengths. The wing retainers may be provided in multiple portions. The multiple portions may overlap, partially overlap or not overlap (e.g. a top portion is offset from a bottom portion). The portions may be staggered, and their lengths configured, to obtain a desired resistance to insertion of the wings.

Figure 13:
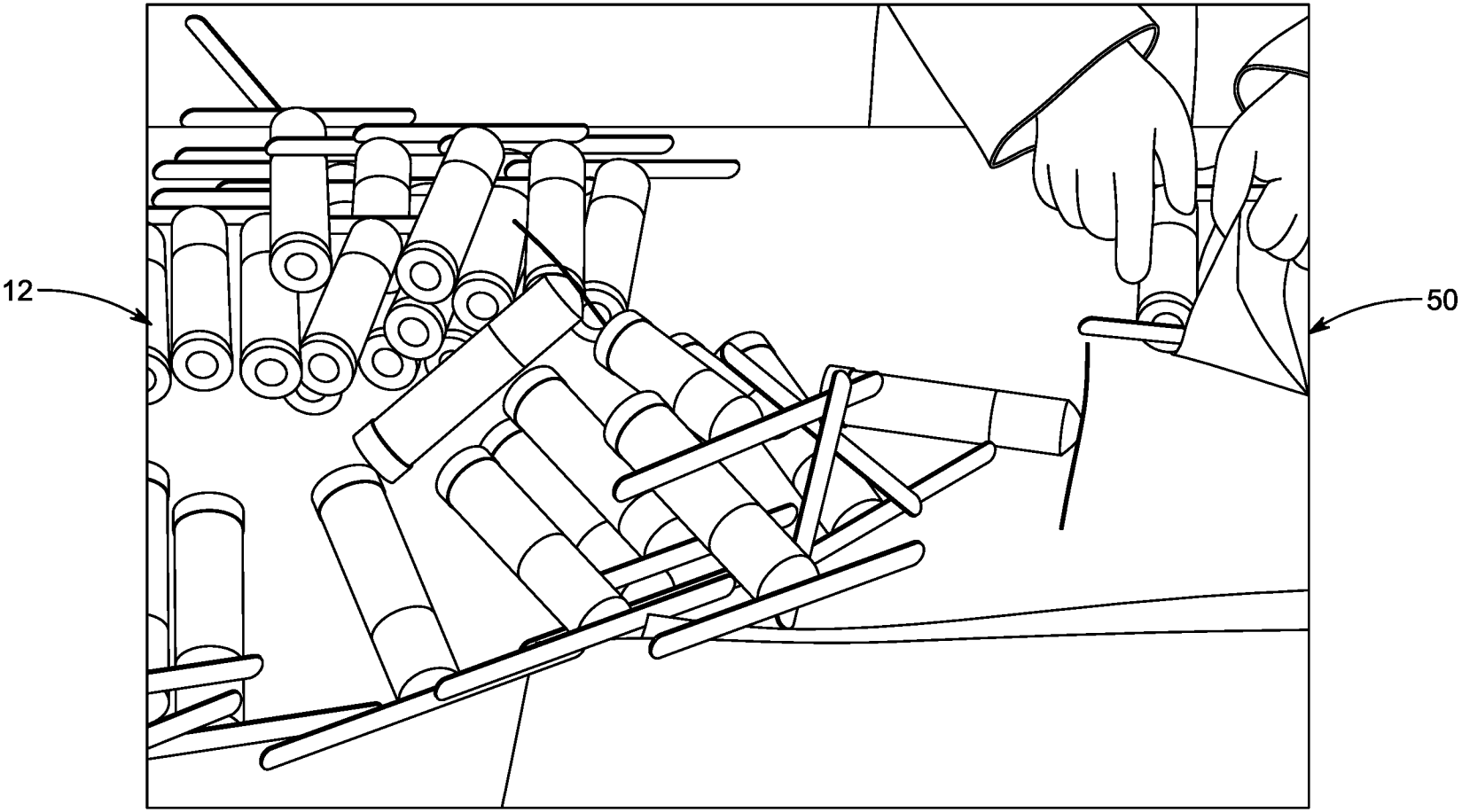
Figure 13 PRIOR ART
FIG. 13 is a perspective view of a stage of packaging of multiple winged capsules without wing protectors.

FIG. 13 is a perspective view of a stage of packaging of multiple winged capsules 12 without wing protectors. A bag, or packaging, 50 is shown being filled by a person. As the packaging is filled, or during transportation, twisting pressure can be applied to the wings, which can break the wings and/or the joint. Wing protectors 20, 40 are configured to limit or eliminate damage that results from such bending. In one variation, the edges of wing retainer 46 forming dome cage 36 contact stabilization surface 19 to provide additional support.

Figure 14:
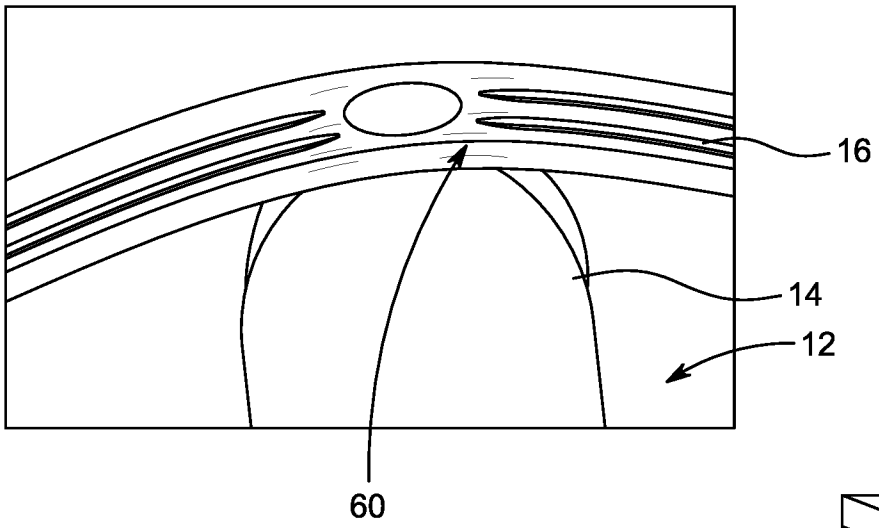
Figure 14 PRIOR ART
FIGS. 14 and 15 are perspective views illustrating material yield locations on wings.
Figure 15:
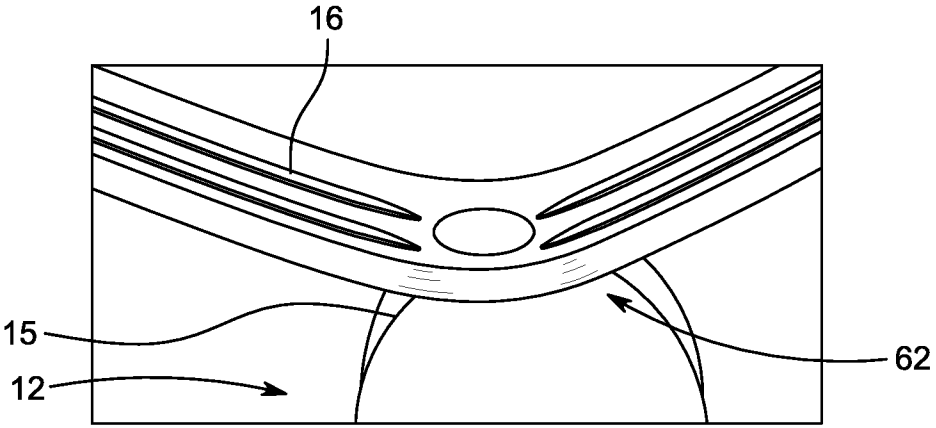
Figure 15 PRIOR ART

FIGS. 14 and 15 show wings bent near the joint. FIG. 14 illustrates a yield area 60, atop the wing, resulting from the wing being bent downward. FIG. 15 illustrates a yield area 62, below the wing, resulting from the wing being bent upward. As used herein, upward indicates a direction away from the capsule and downward indicates a direction toward the capsule, in both cases parallel to the longitudinal axis of the capsule. In both views it appears as if both wings were bent in the same direction, which could result from pulling or pushing the capsule. The wing protector, attached to both wings, would have prevented such bending, thus preventing damage.

Except where a contrary intent is expressly stated, the terms "comprises," "comprising," "containing," and "having" and the like mean "includes," "including," and the like, and are generally interpreted to be open ended transition terms. The recitation of components, structures, steps, or the like specifically listed following an open-ended transition term in no way limit such claim to the components, structures, steps, or the like specifically listed. The terms "consisting of" or "consists of" are closed transition terms.

Except where a contrary intent is expressly stated, the terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

Except where a contrary intent is expressly stated, terms are used in their singular form for clarity and are intended to include their plural form.

Occurrences of the phrase "in one embodiment," or "in one aspect," herein do not necessarily all refer to the same embodiment or aspect.

While this invention has been described as having designs illustrated by embodiments and examples, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An arrangement for delivery of a substance to an animal, the arrangement comprising:

a winged capsule including a capsule and wings, the capsule being adapted to deliver the substance to the animal, and the wings affixed to the capsule and operable to fold for insertion into the animal and to expand after insertion; and a wing protector adapted to hold the wings in the expanded position, the wing protector including a slot sized and shaped to receive at least a portion of each of the wings to removably attach the winged capsule to the wing protector.

2. The arrangement of claim 1, wherein the wing protector comprises a top wall, a lateral wall extending from the top wall, and a wing retainer extending from the lateral wall to form, together with the top wall, the slot.

3. The arrangement of claim 1, wherein the wing protector further includes a top wall, a lateral wall extending from the top wall, and a bottom wall extending from the lateral wall opposite the top wall to form the slot therebetween.

4. The arrangement of claim 2, wherein the wing retainer is sized and shaped to form a wing well.

5. The arrangement of claim 2, wherein the wing protector comprises an opposite lateral wall opposite to the lateral wall and extending from the top wall, and an opposite wing retainer extending from the opposite lateral wall to form an opposite slot, the slot and the opposite slot forming a channel.

6. The arrangement of claim 2, wherein the wing retainer is coextensive with the top wall.

7. The arrangement of claim 2, further including a dome cage formed by a cutout in the wing retainer.

8. The arrangement of claim 5, wherein the slot and the opposite slot are parallel to each other along a longitudinal axis of the wing protector.

9. The arrangement of claim 5, wherein the winged capsule comprises a neck connecting the capsule to the wings, the wing protector further including a dome cage formed in the lateral wall, the wing retainer, the opposite lateral wall, and the opposite wing retainer, the dome cage having a length along a longitudinal direction of the wing protector greater than a width of the neck measured along the longitudinal direction of the wing protector.

10. The arrangement of claim 3, wherein the wing protector further includes a wing retainer extending from the top wall toward the bottom wall.

11. The arrangement of claim 3, wherein the winged capsule comprises a neck connecting the capsule to the wings, further including a dome cage formed by a cutout in the bottom wall.

12. The arrangement of claim 9, wherein the wing protector is made from a flexible material that is sufficiently flexible along a transverse direction to enable flexure of the top wall to expand a gap between the wing retainer and the opposite wing retainer until the gap is greater than a width of the wings, thereby enabling insertion of the wings through the expanded gap into the channel.

13. A method of protection of a winged capsule, the method comprising:

providing an arrangement comprising:

a winged capsule including a capsule and wings, the wings connected to the capsule and adapted to fold for insertion into an animal and to expand after insertion, and a wing protector including a slot sized and configured to receive at least a portion of each of the wings to removably attach the winged capsule to the wing protector;

removably attaching the winged capsule to the wing protector to form a protected winged capsule;

inserting a plurality of the protected winged capsule into a bag;

removing one of the protected winged capsule from the bag; and removing the wing protector from the protected winged capsule prior to delivery of the winged capsule to an animal.

14. A wing protector adapted to protect a winged capsule when the winged capsule is in an expanded position, the winged capsule including a capsule and foldable wings affixed to the capsule, the wing protector comprising:

a top wall;

a lateral wall extending from the top wall; and a slot sized and shaped to receive at least a portion of each of the wings to removably attach the winged capsule to the wing protector, the slot formed in part by the top wall and the lateral wall.

15. The wing protector of claim 14, further comprising a wing retainer extending from the lateral wall to form, together with the top wall, the slot.

16. The wing protector of claim 14, further comprising a bottom wall extending from the lateral wall opposite the top wall to form the slot therebetween.

17. The wing protector of claim 15, further comprising an opposite lateral wall opposite to the lateral wall and extending from the top wall, and an opposite wing retainer extending from the opposite lateral wall to form an opposite slot, the slot and the opposite slot forming a channel.

18. The wing protector of claim 17, wherein the slot and the opposite slot are parallel to each other along a longitudinal axis of the wing protector.

19. The wing protector of claim 16, further comprising a wing retainer extending from the top wall toward the bottom wall.

20. The wing protector of claim 16, wherein the winged capsule comprises a neck connecting the capsule to the wings, the wing protector further comprising a dome cage formed by a cutout in the bottom wall.

* * * * *